US010041224B2

(12) United States Patent
Kondo et al.

(10) Patent No.: US 10,041,224 B2
(45) Date of Patent: Aug. 7, 2018

(54) LIQUID-PRESSURE DRIVING SYSTEM

(71) Applicant: KAWASAKI JUKOGYO KABUSHIKI KAISHA, Kobe-shi, Hyogo (JP)

(72) Inventors: Akihiro Kondo, Nishinomiya (JP); Makoto Ito, Kobe (JP); Kazuto Fujiyama, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 241 days.

(21) Appl. No.: 15/113,926

(22) PCT Filed: Jan. 14, 2015

(86) PCT No.: PCT/JP2015/000144
§ 371 (c)(1),
(2) Date: Jul. 25, 2016

(87) PCT Pub. No.: WO2015/111390
PCT Pub. Date: Jul. 30, 2015

(65) Prior Publication Data

US 2016/0348335 A1 Dec. 1, 2016

(30) Foreign Application Priority Data

Jan. 23, 2014 (JP) ..... 2014-010409

(51) Int. Cl.
*E02F 9/22* (2006.01)
*E02F 3/42* (2006.01)
(Continued)

(52) U.S. Cl.
CPC ..... *E02F 3/422* (2013.01); *E02F 9/2004* (2013.01); *E02F 9/2225* (2013.01);
(Continued)

(58) Field of Classification Search
CPC ..... E02F 9/2296; E02F 3/42; E02F 9/2292
See application file for complete search history.

(56) References Cited

U.S. PATENT DOCUMENTS 8,973,358 B2 * 3/2015 Kuehn ..... F15B 11/17 60/420
2010/0000211 A1 * 1/2010 Ikeda ..... E02F 9/2232 60/422

(Continued)

FOREIGN PATENT DOCUMENTS

JP 2009-002441 A 1/2009
JP 2009-293021 A 12/2009

(Continued)

OTHER PUBLICATIONS

Apr. 21, 2015 International Search Report issued in International Patent Application No. PCT/JP2015/000144.

(Continued)

*Primary Examiner* — Thomas E Lazo
(74) *Attorney, Agent, or Firm* — Oliff PLC

(57) ABSTRACT

A hydraulic driving system includes first to third liquid-pressure pumps and control valves. The first boom control valve is connected to the first hydraulic pump, and the second arm control valve and the first bucket control valve are connected to the second liquid-pressure pump. Further, the turning control valve and the second bucket control valve are connected to the third hydraulic pump. When a pilot pressure XAk0 is output from a bucket operating device while a turning operation is performed, a command switching device outputs a pilot pressure XAk1 to the first bucket control valve. When the pilot pressure XAk0 is output from the bucket operating device while the turning operation is performed, the command switching device outputs a pilot pressure XAk2 to a second bucket control valve.

7 Claims, 4 Drawing Sheets

(51) Int. Cl.
*F15B 11/17* (2006.01)
*E02F 9/20* (2006.01)
*F15B 13/06* (2006.01)

(52) U.S. Cl.
CPC ..... *E02F 9/2228* (2013.01); *E02F 9/2242* (2013.01); *E02F 9/2282* (2013.01); *E02F 9/2285* (2013.01); *E02F 9/2292* (2013.01); *E02F 9/2296* (2013.01); *F15B 11/17* (2013.01); *F15B 13/06* (2013.01); *E02F 9/2232* (2013.01); *F15B 2211/20546* (2013.01); *F15B 2211/20553* (2013.01); *F15B 2211/20576* (2013.01); *F15B 2211/255* (2013.01); *F15B 2211/30595* (2013.01); *F15B 2211/329* (2013.01); *F15B 2211/355* (2013.01); *F15B 2211/45* (2013.01); *F15B 2211/6316* (2013.01); *F15B 2211/6355* (2013.01); *F15B 2211/7058* (2013.01); *F15B 2211/71* (2013.01); *F15B 2211/7135* (2013.01); *F15B 2211/7142* (2013.01)

(56) References Cited

U.S. PATENT DOCUMENTS

2010/0043420 A1* 2/2010 Ikeda ..... E02F 9/2239 60/420
2013/0098014 A1 4/2013 Kuehn et al.

FOREIGN PATENT DOCUMENTS

JP 2012-021311 A 2/2012
JP 2013-148175 A 8/2013

OTHER PUBLICATIONS

Aug. 4, 2016 International Preliminary Report on Patentability issued in International Patent Application No. PCT/JP2015/000144.
Apr. 12, 2017 Office Action issued in Chinese Patent Application No. 201380027881.X.

* cited by examiner

LIQUID-PRESSURE DRIVING SYSTEM

TECHNICAL FIELD

The present invention relates to a liquid-pressure driving system configured to drive a turning motor, an arm actuator, a boom actuator, and a bucket actuator.

BACKGROUND ART

A construction machine such as a hydraulic excavator includes a hydraulic driving system and a plurality of actuators and drives the actuators by introducing pressure oil from the hydraulic driving system to the actuators. Known as the hydraulic driving system of the construction machine configured as above is, for example, a hydraulic driving device of PTL 1.

The hydraulic driving device of PTL 1 includes three pumps. By introducing operating oil from these three pumps to various actuators such as a traveling motor, a turning motor, a boom actuator, an arm actuator, and a bucket actuator, the hydraulic driving device can perform traveling, turning, lifting and lowering of a boom, bending and extending of an arm, and excavating and dumping of a bucket. Those actuators are provided with corresponding control valves, and each of the control valves changes a state of supplying the operating oil to the corresponding actuator. Those control valves constitute three control valve groups, and a first control valve group is connected to a first pump. A second control valve group and a third control valve group are connected to a second pump and a third pump, respectively.

The first control valve group includes a turning control valve, a boom control valve, an arm control valve, and a bucket control valve. The second control valve group includes an arm control valve, a boom control valve, and a bucket control valve. The third control valve group includes an arm control valve. By operating lever devices correspondingly provided at the control valves of the second and third control valve groups, pilot pressure is input to the control valves of the second and third control valve groups. The control valves of the second and third control valve groups operate by the pilot pressure to supply the operating oil, ejected from the second and third pumps, to the corresponding actuators. Further, by operating the lever devices correspondingly provided at the control valves of the first control valve group other than the turning control valve, pilot pressure regulated by an electromagnetic control valve is input to the control valves of the first control valve group other than the turning control valve. When the turning control valve operates, the pilot pressure input to the control valves of the first control valve group other than the turning control valve is blocked. Thus, when the boom, the arm, or the bucket is operated at the same time as the turning operation, the operating oil ejected from the third pump can be supplied only to the turning motor.

CITATION LIST

Patent Literature

PTL 1: Japanese Laid-Open Patent Application Publication No. 2012-21311

SUMMARY OF INVENTION

Technical Problem

In the hydraulic driving device of PTL 1, the control valves of the first control valve group other than the turning control valve are utilized as control valves that assist the control valves of the second and third control valve groups. To be specific, when the amount of operating oil supplied from the control valves of the second and third control valve groups to the corresponding actuators is inadequate, the control valves of the first control valve group other than the turning control valve supply the operating oil to those actuators. Further, the pilot pressure input to the control valves of the first control valve group other than the turning control valve is blocked at the time of the turning operation. Therefore, when the boom, the arm, or the bucket is operated at the same time as the turning operation, the operating oil cannot be supplied to each actuator, such as the boom, the arm, or the bucket, at a required flow rate.

An object of the present invention is to provide a liquid-pressure driving system capable of introducing operating oil to each actuator such as a boom, an arm, or a bucket at a required flow rate even when the actuator is operated at the same time as a turning operation.

Solution to Problem

A liquid-pressure driving system of the present invention includes: first and second liquid-pressure pump each configured to supply a pressure liquid to a boom actuator through a boom control valve, to an arm actuator through an arm control valve, and to a bucket actuator through a first bucket control valve; a third liquid-pressure pump configured to supply the pressure liquid to the bucket actuator through a second bucket control valve and to a turning motor through a turning control valve; and a command output device configured to when operating the bucket actuator while the pressure liquid is supplied from the third liquid-pressure pump to the turning motor, output a first bucket drive command to the first bucket control valve such that the pressure liquid is supplied from the first or second liquid-pressure pump through the first bucket control valve to the bucket actuator and when operating the bucket actuator while the pressure liquid is not supplied to the turning motor, output a second bucket drive command such that the pressure liquid is supplied from the third liquid-pressure pump through the second bucket control valve to the bucket actuator.

According to the present invention, the pressure liquid is not supplied to the boom actuator and the arm actuator from the third liquid-pressure pump configured to supply the pressure liquid to the turning motor. Therefore, regardless of whether or not the pressure liquid is supplied to the turning motor, the pressure liquid can be supplied from the first or second liquid-pressure pump to the boom actuator or the arm actuator at a required flow rate. Further, the pressure liquid can be supplied to the bucket actuator from not only the third liquid-pressure pump but also the first or second liquid-pressure pump through the first bucket control valve, and the first to third liquid-pressure pumps are selectively used in accordance with whether or not the pressure liquid is supplied to the turning motor. Therefore, the pressure liquid can be introduced from the first to third liquid-pressure pumps to the bucket actuator at a required flow rate regardless of whether or not the turning operation is performed.

As above, according to the present invention, the pressure liquid can be supplied to each of the boom actuator, the arm actuator, and the bucket actuator at a required flow rate regardless of whether or not the pressure liquid is supplied to the turning motor. Therefore, even when the boom, the arm, or the bucket is operated at the same time as the turning operation, the pressure liquid can be introduced to each actuator at a required flow rate.

In the above invention, the liquid-pressure driving system may further include a bucket operating device including an operating lever and configured to output a bucket drive command in accordance with an operation amount of the operating lever, wherein: the first to third liquid-pressure pumps may be configured such that ejection amounts thereof are substantially the same as one another; the bucket operating device includes the operating lever that is operable and outputs the bucket drive command in accordance with the operation amount of the operating lever; the command output device may output the first bucket drive command or the second bucket drive command in accordance with the bucket drive command; and the first bucket control valve may connect the first to third pressure liquid pumps and the bucket actuator by an opening area corresponding to the first bucket drive command from the command output device, and the second bucket control valve may connect the first to third pressure liquid pumps and the bucket actuator by an operating area corresponding to the second bucket drive command from the command output device, the opening area of the first bucket control valve and the opening area of the second bucket control valve being substantially the same as each other when the first bucket drive command and the second drive command are substantially the same as each other.

According to the above configuration, when the first bucket drive command and the second bucket drive command are substantially the same as each other, the extension/contraction speed of the bucket actuator based on the first bucket drive command and the extension/contraction speed of the bucket actuator based on the second bucket drive command can be made substantially the same as each other. With this, regardless of whether or not the turning operation is performed at the same time, the bucket can be operated by the substantially same operational feeling.

In the above invention, the liquid-pressure driving system may be configured such that: the arm control valve is connected to at least one of the first liquid-pressure pump and the second liquid-pressure pump; and the boom control valve is connected to the other liquid-pressure pump.

According to the above configuration, when supplying the pressure liquid to the arm actuator and the boom actuator at the same time, the pressure liquid can be supplied to those actuators from different liquid-pressure pumps through the corresponding control valves. Therefore, even when the arm operating device and the boom operating device are operated at the same time, the lack of the flow rate of the pressure liquid introduced to each actuator can be suppressed.

In the above invention, the liquid-pressure driving system may be configured such that: the arm control valve includes two arm control valves, and the two arm control valves are connected to the first liquid-pressure pump and the second liquid-pressure pump, respectively; the boom control valve includes two boom control valves, and the two boom control valves are connected to the first liquid-pressure pump and the second liquid-pressure pump, respectively; when lowering a boom, one of the two boom control valves stops supply of the pressure liquid to the bucket actuator from the liquid-pressure pump to which the one boom control valve is connected; and the first bucket control valve is connected to the liquid-pressure pump to which the one boom control valve is connected.

According to the above configuration, when lowering the boom, the pressure liquid of one of the liquid-pressure pumps is not supplied to the boom actuator. Therefore, even when the boom is lowered and the bucket is driven while the pressure liquid is supplied to the turning motor, the pressure liquid can be supplied to the bucket actuator at a required flow rate.

In the above invention, the liquid-pressure driving system may be configured such that: the first to third liquid-pressure pumps are variable displacement pumps; the first to third liquid-pressure pumps are provided with first to third regulators, respectively, the first to third regulators being configured to control ejection amounts of the first to third liquid-pressure pumps, respectively; and the third regulator controls the ejection amount of the third liquid-pressure pump separately from the ejection amounts of the first and second liquid-pressure pumps.

According to the above configuration, when supplying the pressure liquid to the turning motor, the third liquid-pressure pump can eject the pressure liquid at a flow rate required for the turning motor. Thus, energy saving of the liquid-pressure driving system can be achieved.

In the above invention, the liquid-pressure driving system may be configured such that: the first bucket control valve includes a first bucket spool configured to move to a position corresponding to the first bucket drive command and connect the liquid-pressure pump and the bucket actuator by an opening area corresponding to an amount of movement of the first bucket spool and a movement regulating mechanism configured to regulate the amount of movement of the first bucket spool; and when the pressure liquid is supplied to at least one of the boom actuator and the arm actuator while the pressure liquid is supplied to the turning motor, and the command output device outputs the first bucket drive command, the movement regulating mechanism regulates the amount of movement of the first bucket spool, According to the above configuration, when supplying the pressure liquid to the bucket and one of the arm actuator and the boom actuator at the same time while the pressure liquid is supplied to the turning motor, the amount of movement of the bucket spool of the bucket control valve can be regulated. With this, the pressure liquid can be prevented from being introduced at an excessive flow rate to the bucket actuator whose load is low. Thus, the bucket whose load is low and the arm or boom whose load is high can be operated at the same time.

In the above invention, the liquid-pressure driving system may be configured such that: the command output device includes an electromagnetic control valve configured to adjust a pilot pressure output as the first bucket drive command to the first bucket control valve and a control unit configured to control an operation of the electromagnetic control valve; the first bucket control valve connects the liquid-pressure pump and the bucket actuator by an opening area corresponding to the pilot pressure, and the opening area of the first bucket control valve decreases when the pilot pressure is reduced; and when the pressure liquid is supplied to at least one of the boom actuator and the arm actuator while the pressure liquid is supplied to the turning motor, and the command output device outputs the first bucket drive command, the control unit reduces the pilot pressure by the electromagnetic control valve.

According to the above configuration, when supplying the pressure liquid to the bucket and one of the arm actuator and the boom actuator at the same time while the pressure liquid is supplied to the turning motor, the amount of movement of the bucket spool of the bucket control valve can be regulated. With this, the pressure liquid can be prevented from being introduced at an excessive flow rate to the bucket actuator whose load is low. Thus, the bucket whose load is low and the arm or boom whose load is high can be operated at the same time.

Advantageous Effects of Invention

According to the present invention, even when a boom, an arm, or a bucket is operated at the same time as a turning operation, pressure liquid can be introduced to each actuator at a required flow rate.

The above object, other objects, features, and advantages of the present invention will be made clear by the following detailed explanation of preferred embodiments with reference to the attached drawings.

DESCRIPTION OF EMBODIMENTS

Figure 1:
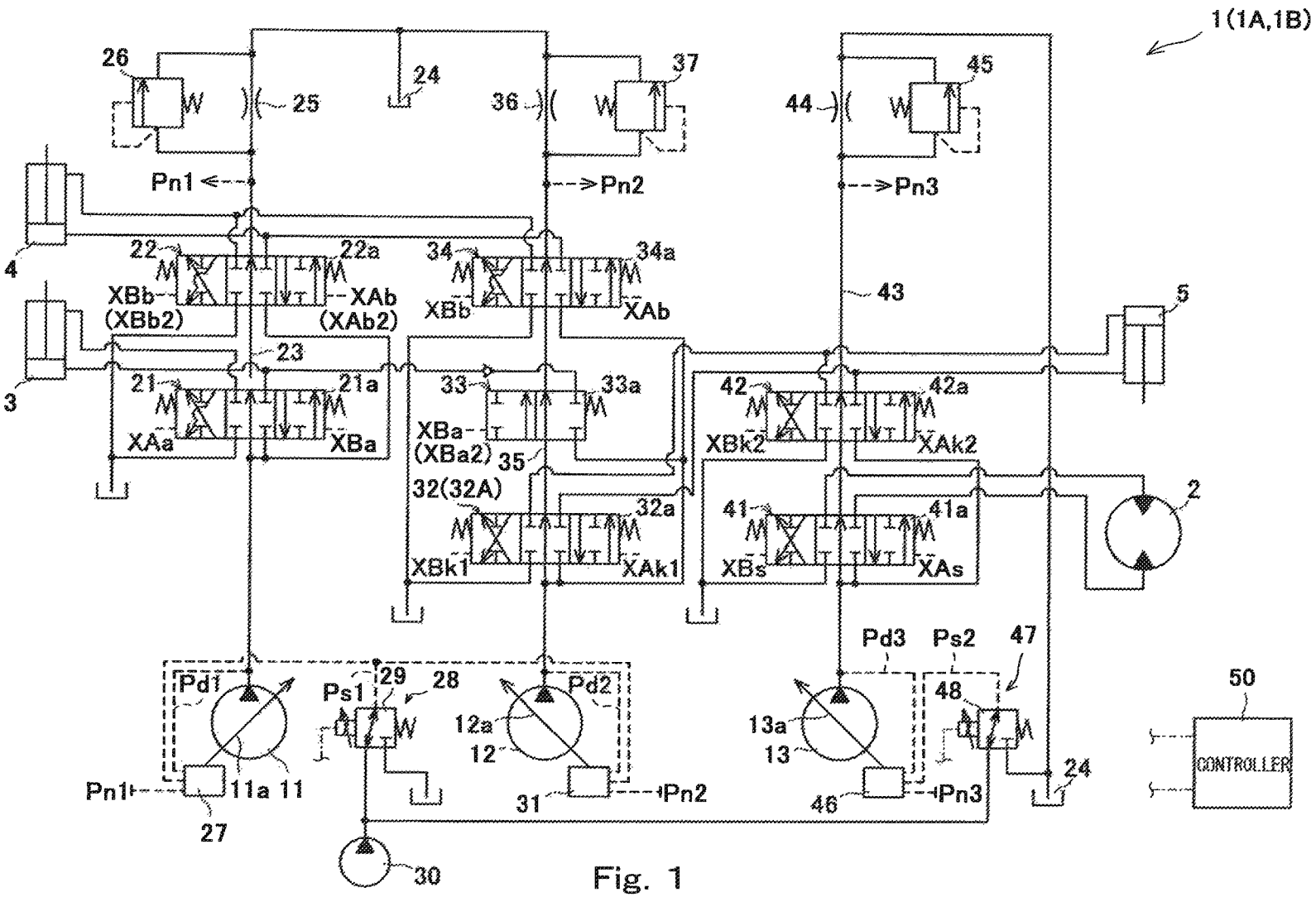
FIG. 1 is a circuit diagram showing a hydraulic circuit of a driving system of a hydraulic driving system according to Embodiment 1 of the present invention.

Hereinafter, hydraulic driving systems 1, 1A, and 1B according to Embodiments 1 to 3 of the present invention will be explained in reference to the drawings. It should be noted that a concept of directions mentioned in the following explanations is used for convenience of explanation, and this concept does not limit the directions and the like of components of the present invention. Further, each of the hydraulic driving systems 1, 1A, and 1B explained below is just one embodiment of the present invention. Therefore, the present invention is not limited to those embodiments, and additions, deletions, and modifications may be made within the scope of the present invention.

A construction machine such as a hydraulic excavator includes a turning body (not shown) attached to a traveling device or a base body so as to be turnable. A boom is attached to the turning body. The boom is configured to be swingable in an upward/downward direction (i.e., to be able to be lifted and lowered) relative to the turning body. An arm is attached to a tip end portion of the boom. The arm is configured to be swingable in the upward/downward direction (i.e., to be able to be bent and extended) relative to the boom. Further, a bucket is attached to a tip end portion of the arm. The bucket is configured to be swingable in a forward/rearward direction (i.e., to be able to perform excavating and dumping). The construction machine configured as above includes a turning motor 2, a boom actuator 3, an arm actuator 4, and a bucket actuator 5 for operating the turning body, the boom, the arm, and the bucket. The turning motor 2 is constituted by a hydraulic motor, and the actuators 3 to 5 are constituted by hydraulic cylinders. To be specific, the turning motor 2 and the actuators 3 to 5 are driven by operating oil, and the construction machine includes a hydraulic driving system 1 for driving the turning motor 2 and the actuators 3 to 5.

Embodiment 1

The hydraulic driving system 1 according to Embodiment 1 includes three hydraulic pumps 11 to 13. These three hydraulic pumps 11 to 13 are constituted by, for example, variable displacement swash plate pumps. Each of the hydraulic pumps 11 to 13 can change an ejection flow rate of the operating oil by changing a tilt angle of a corresponding swash plate 11*a*, 12*a*, or 13*a*. The three hydraulic pumps 11 to 13 are hydraulic pumps (same hydraulic pumps) that are substantially the same in functions as one another (for example, maximum and minimum ejection amounts are substantially the same among the hydraulic pumps 11 to 13, and the ejection amounts relative to the tilt angles of the swash plates 11*a* to 13*a* are substantially the same among the hydraulic pumps 11 to 13). A first boom control valve 21 and a first arm control valve 22 are connected in parallel to a first hydraulic pump 11 that is one of the hydraulic pumps 11 to 13. The operating oil ejected from the first hydraulic pump 11 is introduced to the first boom control valve 21 and the first arm control valve 22.

The first boom control valve 21 includes a spool 21*a* and is connected to the boom actuator 3. The first arm control valve 22 includes a spool 22*a* and is connected to the arm actuator 4. By moving the spool 21*a*, the first boom control valve 21 connects the first hydraulic pump 11 and the actuator 3 to allow the flow of the operating oil to the actuator 3. The first boom control valve 21 changes the direction of the operating oil flowing to the actuator 3 depending on the position of the spool 21*a*. Similarly, by moving the spool 22*a*, the first arm control valve 22 connects the first hydraulic pump 11 and the actuator 4 to allow the flow of the operating oil to the actuator 4. The first arm control valve 22 changes the direction of the operating oil flowing to the actuator 4 depending on the position of the spool 22*a*. By moving the spools 21*a* and 22*a*, the control valves 21 and 22 configured as above can extend or contact the actuators 3 and 4 (i.e., can lift or lower the boom and extend or bend the arm). By returning the spools 21*a* and 22*a* to neutral positions, the control valves 21 and 22 configured as above can block the communication between the first hydraulic pump 11 and the actuator 3 and the communication between the first hydraulic pump 11 and the actuator 4 to stop the operations of the actuators 3 and 4.

Although not shown in FIG. 1, in the hydraulic driving system 1, a variable restrictor is interposed between the first hydraulic pump 11 and the first arm control valve 22. When operating the boom actuator 3, the variable restrictor restricts the operating oil flowing from the first hydraulic pump 11 to the first arm control valve 22, and therefore, the operating oil from the first hydraulic pump 11 is introduced preferentially to the first boom control valve 21.

The first hydraulic pump 11 is connected to a first center bleed line 23. The operating oil ejected from the first hydraulic pump 11 is discharged to a tank 24 through the first center bleed line 23 (bleed-off). The first boom control valve 21 and the first arm control valve 22 are disposed on the first center bleed line 23 in this order from an upstream side. An opening area of the first center bleed line 23 changes depending on the positions of the spools 21*a* and 22*a*. The opening area is the largest when the spools 21*a* and 22*a* are located at the neutral positions, and the opening area decreases in accordance with the amounts of movements of the spools 21*a* and 22*a* from the neutral positions. Therefore, when the spools 21*a* and 22*a* are moved, the opening area of the first center bleed line 23 is adjusted, and this adjusts the flow rate of the operating oil that is discharged to the tank 24 through the first center bleed line 23.

A first restrictor 25 is disposed on the first center bleed line 23 so as to be located between the first arm control valve 22 and the tank 24. A first relief valve 26 is connected to the first center bleed line 23 so as to avoid the first restrictor 25. In the first center bleed line 23, hydraulic pressure at an upstream of the first restrictor 25 increases or decreases by the first restrictor 25 in accordance with the flow rate of the oil flowing to the first restrictor 25. When the hydraulic pressure at the upstream of the first restrictor 25 exceeds predetermined pressure, the operating oil in the first center bleed line 23 is relieved to the tank 24 by the first relief valve 26. The hydraulic pressure increased or decreased by the first restrictor 25 is input as a first negative control pressure Pn1 to a first regulator 27.

The first regulator 27 adjusts the tilt angle of the swash plate 11*a* of the first hydraulic pump 11 in accordance with hydraulic signals input to the first regulator 27. The first negative control pressure Pn1 and a first ejection pressure Pd1 of the first hydraulic pump 11 are input as the hydraulic signals to the first regulator 27. When the first negative control pressure Pn1 or the first ejection pressure Pd1 increases, the first regulator 27 decreases the tilt angle of the swash plate 11*a* to reduce the ejection flow rate of the first hydraulic pump 11. In contrast, when the first negative control pressure Pn1 or the first ejection pressure Pd1 decreases, the first regulator 27 increases the tilt angle of the swash plate 11*a* to increase the ejection flow rate of the first hydraulic pump 11. Further, a first power shift pressure Ps1 is input from a first horsepower controller 28 to the first regulator 27 configured as above.

The first horsepower controller 28 includes a first electromagnetic proportional valve 29. Pilot oil is introduced from a below-described pilot pump 30 to the first horsepower controller 28. The first electromagnetic proportional valve 29 reduces the pressure of the pilot oil to the first power shift pressure Ps1 corresponding to a first horsepower control signal input to the first electromagnetic proportional valve 29. The first electromagnetic proportional valve 29 outputs the first power shift pressure Ps1 as the hydraulic signal to the first regulator 27. As with the control with respect to the first negative control pressure Pn1 and the first ejection pressure Pd1, the first regulator 27 adjusts the tilt angle of the swash plate 11*a* in accordance with the first power shift pressure Ps to control the ejection flow rate of the first hydraulic pump 11. By inputting the first power shift pressure Ps1 as above, output horsepower of the first hydraulic pump 11 can be reduced. In addition to the first hydraulic pump 11, the first power shift pressure Ps1 is also introduced to a second regulator 31 for a second hydraulic pump 12.

The second regulator 31 is attached to the second hydraulic pump 12 that is one of the remaining two hydraulic pumps 12 and 13. As with the first regulator 27, the second regulator 31 adjusts the tilt angle of the swash plate 12*a* of the second hydraulic pump 12 in accordance with the first power shift pressure Ps1, a below-described second negative control pressure Pn2, and a below-described second ejection pressure Pd2, which are input as the hydraulic signals, to control the ejection flow rate of the second hydraulic pump 12. A first bucket control valve 32, a second boom control valve 33, and a second arm control valve 34 are connected to the second hydraulic pump 12 in parallel.

The first bucket control valve 32 includes a spool 32*a* and is connected to the bucket actuator 5. By moving the spool 32*a*, the first bucket control valve 32 connects the second hydraulic pump 12 and the bucket actuator 5 to allow the flow of the operating oil to the bucket actuator 5. The first bucket control valve 32 changes the direction of the operating oil flowing to the bucket actuator 5 depending on the position of the spool 32*a*. By moving the spool 32*a*, the first bucket control valve 32 configured as above can extend or contract the bucket actuator 5 (i.e., can cause the bucket to perform dumping or excavating). By returning the spool 32*a* to the neutral position, the first bucket control valve 32 configured as above can block the communication between the second hydraulic pump 12 and the bucket actuator 5 to stop the operation of the bucket actuator 5.

The second boom control valve 33 includes a spool 33*a* and is connected to the boom actuator 3. By moving the spool 33*a*, the second boom control valve 33 can connect the second hydraulic pump 12 and the boom actuator 3 to allow the flow of the operating oil to the boom actuator 3 together with the first boom control valve 21. By returning the spool 33*a* to the neutral position, the second boom control valve 33 can block the communication between the second hydraulic pump 12 and the boom actuator 3 to stop the flow of the operating oil to the boom actuator 3. By moving the spool 33*a*, the second boom control valve 33 can extend the boom actuator 3 (i.e., can lift the boom). By returning the spool 33*a* to the neutral position, the second boom control valve 33 can stop the flow of the operating oil to the boom actuator 3.

The second arm control valve 34 includes a spool 34*a* and is connected to the arm actuator 4. By moving the spool 34*a*, the second arm control valve 34 connects the second hydraulic pump 12 and the arm actuator 4 to allow the flow of the operating oil to the arm actuator 4. The second arm control valve 34 changes the direction of the operating oil flowing to the arm actuator 4 depending on the position of the spool 34*a*. By moving the spool 34*a*, the second arm control valve 34 configured as above can extend or contract the arm actuator 4 (i.e., extend or bend the arm). By returning the spool 34*a* to the neutral position, the second arm control valve 34 configured as above can block the communication between the second hydraulic pump 12 and the arm actuator 4 to stop the operation of the arm actuator 4.

The second hydraulic pump 12 is connected to a second center bleed line 35. The operating oil ejected from the second hydraulic pump 12 is discharged to the tank 24 through the second center bleed line 35 (bleed-off). The first bucket control valve 32, the second boom control valve 33, and the second arm control valve 34 are disposed on the second center bleed line 35 in this order from an upstream side. An opening area of the second center bleed line 35 changes depending on the positions of the spools 32*a* to 34*a*. The opening area is the largest when the spools 32*a* to 34*a* are located at the neutral positions, and the opening area decreases in accordance with the amounts of movements of the spools 32*a* to 34*a* from the neutral positions. Therefore, when the spools 32*a* to 34*a* are moved, the opening area of the second center bleed line 35 is adjusted, and this adjusts the flow rate of the operating oil that is discharged to the tank 24 through the second center bleed line 35.

A second restrictor 36 is disposed on the second center bleed line 35 so as to be located between the second arm control valve 34 and the tank 24. A second relief valve 37 is connected to the second center bleed line 35 so as to avoid the second restrictor 36. In the second center bleed line 35, hydraulic pressure at an upstream of the second restrictor 36 increases or decreases by the second restrictor 36 in accordance with the flow rate of the oil flowing to the second restrictor 36. When the hydraulic pressure at the upstream of the second restrictor 36 exceeds predetermined pressure, the operating oil in the second center bleed line 35 is relieved to the tank 24 by the second relief valve 37. The hydraulic pressure increased or decreased by the second restrictor 36 is input as the second negative control pressure Pn2 to the second regulator 31 together with the ejection pressure Pd2 of the second hydraulic pump 12.

The second regulator 31 adjusts the tilt angle of the swash plate 12*a* of the second hydraulic pump 12 in accordance with the second negative control pressure Pn2, the ejection pressure Pd2, and the first power shift pressure Ps1 which are input to the second regulator 31. Since the first power shift pressure Ps1 is introduced to the second regulator 31, output horsepower of the second hydraulic pump 12 can be changed together with the first hydraulic pump 11. On the other hand, output horsepower of the third hydraulic pump 13 can be controlled independently from the first hydraulic pump 11 and the second hydraulic pump 12. A turning control valve 41 and a second bucket control valve 42 are connected to the third hydraulic pump 13 in parallel. The operating oil ejected from the third hydraulic pump 13 is introduced to the turning control valve 41 and the second bucket control valve 42.

The turning control valve 41 includes a spool 41*a* and is connected to the turning motor 2. The second bucket control valve 42 includes a spool 42*a* and is connected to the bucket actuator 5. By moving the spool 41*a*, the turning control valve 41 connects the third hydraulic pump 13 and the turning motor 2 to allow the flow of the operating oil to the turning motor 2. The turning control valve 41 changes the direction of the operating oil flowing to the turning motor 2 depending on the position of the spool 41*a*. To be specific, by moving the spool 41*a*, the turning control valve 41 can rotate the turning motor 2 clockwise or counterclockwise (i.e., rotate the turning body clockwise or counterclockwise). By returning the spool 41*a* to the neutral position, the turning control valve 41 can block the communication between the third hydraulic pump 13 and the turning motor 2 to stop the operation of the turning motor 2.

Basically, the second bucket control valve 42 is substantially the same in configuration as the first bucket control valve 32. By moving the spool 42*a*, the second bucket control valve 42 connects the third hydraulic pump 13 and the bucket actuator 5 to allow the flow of the operating oil to the bucket actuator 5. The second bucket control valve 42 changes the direction of the operating oil flowing to the bucket actuator 5 depending on the position of the spool 42*a*. By moving the spool 42*a*, the second bucket control valve 42 configured as above can extend or contract the bucket actuator 5 (i.e., can cause the bucket to perform excavating or dumping). By returning the spool 42*a* to the neutral position, the second bucket control valve 42 can block the communication between the third hydraulic pump 13 and the bucket actuator 5 to stop the operation of the bucket actuator 5.

The third hydraulic pump 13 is connected to a third bleed-off line 43. The operating oil ejected from the third hydraulic pump 13 is discharged to the tank 24 through the third bleed-off line 43 (bleed-off). The turning control valve 41 and the second bucket control valve 42 are disposed on the third bleed-off line 43 in this order from an upstream side. An opening area of the third bleed-off line 43 changes depending on the positions of the spools 41*a* and 42*a*. The opening area is the largest when the spools 41*a* and 42*a* are located at the neutral positions, and the opening area decreases in accordance with the amounts of movements of the spools 41*a* and 42*a* from the neutral positions. Therefore, when the spools 41*a* and 42*a* are moved, the opening area of the third bleed-off line 43 is adjusted, and this adjusts the flow rate of the operating oil that is discharged to the tank 24 through the third bleed-off line 43.

A third restrictor 44 is disposed on the third bleed-off line 43 so as to be located between the second bucket control valve 42 and the tank 24. A third relief valve 45 is connected to the third bleed-off line 43 so as to avoid the third restrictor 44. In the third bleed-off line 43, hydraulic pressure at an upstream of the third restrictor 44 increases or decreases by the third restrictor 44 in accordance with the flow rate of the oil flowing to the third restrictor 44. When the hydraulic pressure at the upstream of the third restrictor 44 exceeds predetermined pressure, the operating oil in the third bleed-off line 43 is relieved to the tank 24 by the third relief valve 45. The hydraulic pressure increased or decreased by the third restrictor 44 is input as a third negative control pressure Pn3 to a third regulator 46.

The third regulator 46 adjusts the tilt angle of the swash plate 13*a* of the third hydraulic pump 13 in accordance with hydraulic signals input to the third regulator 46. The third negative control pressure Pn3 and a third ejection pressure Pd3 of the third hydraulic pump 13 are input as the hydraulic signals to the third regulator 46. When the third negative control pressure Pn3 or the third ejection pressure Pd3 increases, the third regulator 46 decreases the tilt angle of the swash plate 13*a* to reduce the ejection flow rate of the third hydraulic pump 13. In contrast, when the third negative control pressure Pn3 or the third ejection pressure Pd3 decreases, the third regulator 46 increases the tilt angle of the swash plate 13*a* to increase the ejection flow rate of the third hydraulic pump 13. Further, a second power shift pressure Ps2 is input from a second horsepower controller 47 to the third regulator 46 configured as above.

The second horsepower controller 47 includes a second electromagnetic proportional valve 48. Pilot oil is introduced from the pilot pump 30 to the second horsepower controller 47. The second electromagnetic proportional valve 48 reduces the pressure of the pilot oil to the second power shift pressure Ps2 corresponding to a second horsepower control signal input to the second electromagnetic proportional valve 48. The second electromagnetic proportional valve 48 outputs the second power shift pressure Ps2 as the hydraulic signal to the third regulator 46. As with the control with respect to the second negative control pressure Pn2 and the second ejection pressure Pd2, the third regulator 46 adjusts the tilt angle of the swash plate 13*a* in accordance with the second power shift pressure Ps2 to control the ejection flow rate of the third hydraulic pump 13. By inputting the second power shift pressure Ps2 as above, output horsepower of the third hydraulic pump 13 can be reduced independently from the output horsepower of the first hydraulic pump 11 and the output horsepower of the second hydraulic pump 12.

The hydraulic driving system 1 includes a controller 50. The controller 50 outputs the first horsepower control signal and the second horsepower control signal to the first horsepower controller 28 and the second horsepower controller 47 in accordance with a command from a command device (not shown) to control the first electromagnetic proportional valve 29 and the second electromagnetic proportional valve 48. With this, the power shift pressure Ps1 and Ps2 can be output by the controller 50 in accordance with the command, and the output horsepowers of the hydraulic pumps 11 to 13 are controlled. By controlling the output horsepowers as above, the output horsepowers of the first to third hydraulic pumps 11 to 13 can be controlled without measuring motor pressure or pump discharge pressure by a hydraulic sensor. Thus, the hydraulic driving system 1 can be provided at low cost.

Figure 2:
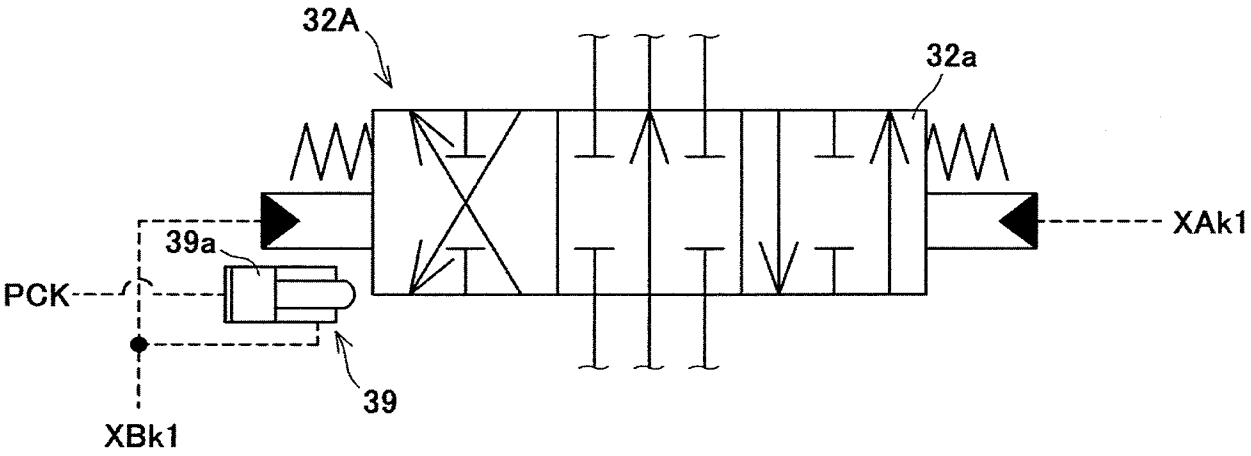
FIG. 2 is a circuit diagram show in a hydraulic circuit of an operating system of the hydraulic driving system of FIG. 1.
Figure 3:
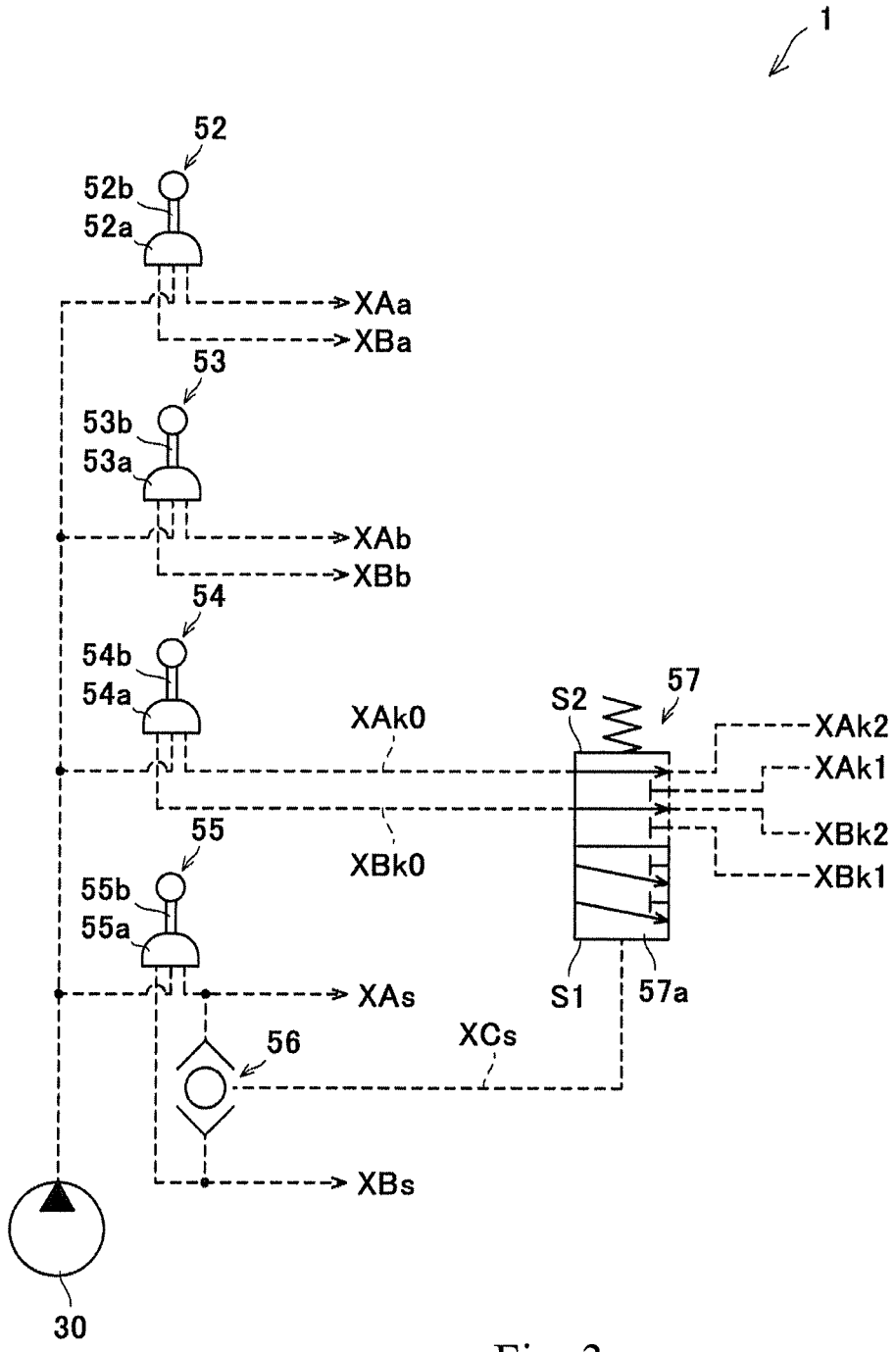
FIG. 3 is a circuit diagram showing the hydraulic circuit of the operating system of the hydraulic driving system according to Embodiment 2 of the present invention.
Figure 4:
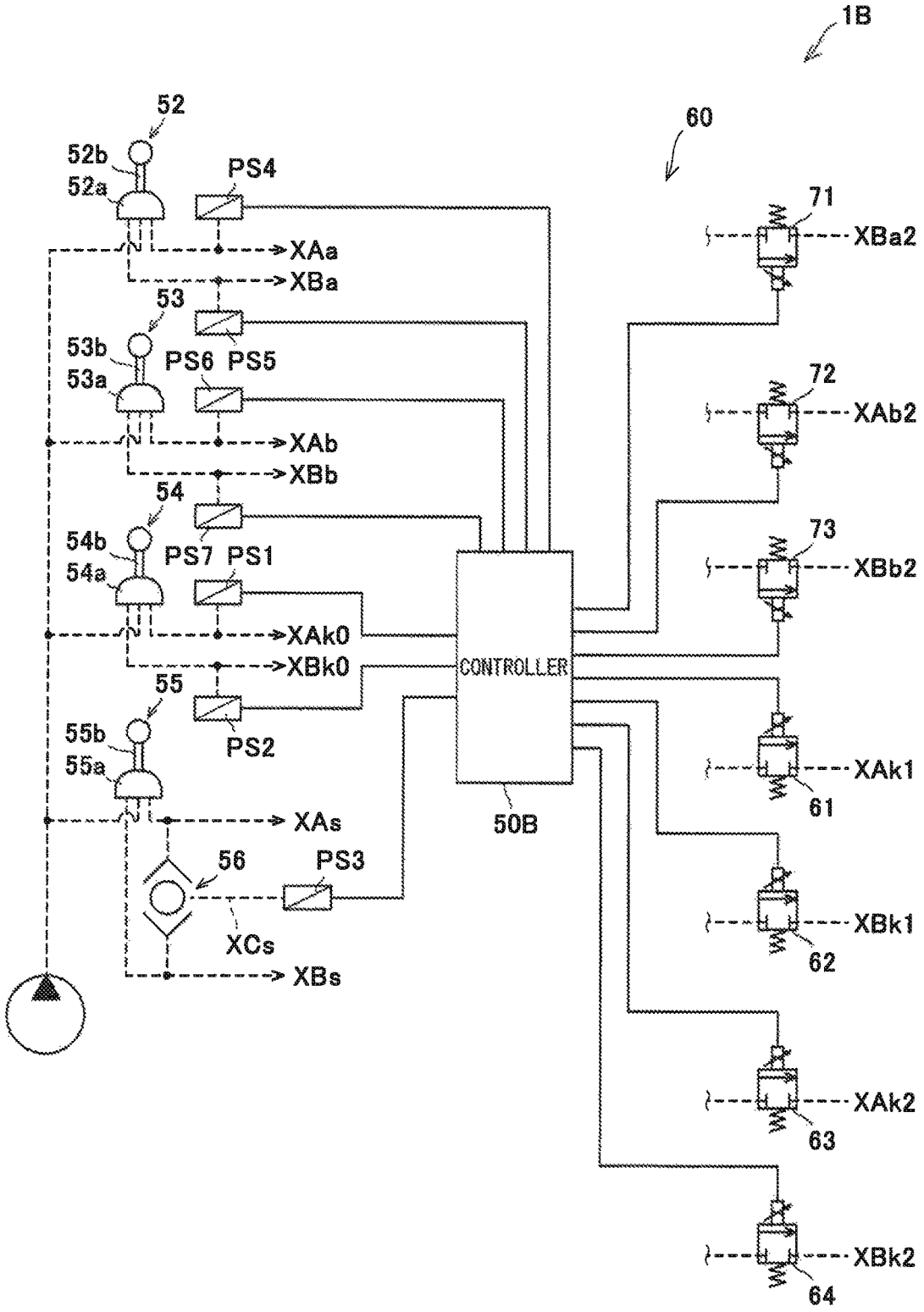
FIG. 4 is a circuit diagram showing the hydraulic circuit of the operating system of the hydraulic driving system according to Embodiment 3 of the present invention.

As above, the hydraulic driving system 1 includes the three hydraulic pumps 11 to 13. The control valves 21, 22, 32, 33, 34, 41, and 42 are separately connected to the hydraulic pumps 11 to 13. To be specific, the first boom control valve 21 and the first arm control valve 22 are connected to the first hydraulic pump 11. The first bucket control valve 32, the second boom control valve 33, and the second arm control valve 34 are connected to the second hydraulic pump 12. The turning control valve 41 and the second bucket control valve 42 are connected to the third hydraulic pump 13. The first bucket control valve 32 and the second bucket control valve 42 are connected to the hydraulic pumps 12 and 13, respectively. As shown in FIG. 2, to operate the control valves 21, 22, 32, 33, 34, 41, and 42 connected as above, the hydraulic driving system 1 includes four operating devices 52 to 55 that are a boom operating device 52, an arm operating device 53, a bucket operating device 54, and a turning operating device 55.

These four operating devices 52 to 55 are constituted by operating valves 52*a* to 55*a*, respectively, and the operating valves 52*a* to 55*a* include operating levers 52*b* to 55*b*, respectively. The operating valves 52*a* to 55*a* are connected to the pilot pump 30. By operating the operating lever 52*b*, 53*b*, 54*b*, or 55*b* of the operating valve 52*a*, 53*a*, 54*a*, or 55*a*, the operating device 52, 53, 54, or 55 outputs the pilot pressure that has been reduced to pressure corresponding to an operation amount of the operating lever 52*b*, 53*b*, 54*b*, or 55*b*. The output pilot pressure is input to the control valve 21, 22, 32, 33, 34, 41, or 42, and the control valve 21, 22, 32, 33, 34, 41, or 42 changes the position of the spool 21*a*, 22*a*, 32*a*, 33*a*, 34*a*, 41*a*, or 42*a* in accordance with the input pilot pressure to allow the flow of the operating oil to the actuator 2, 3, 4, or 5. Hereinafter, the configurations and operations of the operating devices 52 to 55 will be explained in detail in reference to FIGS. 1 and 2.

When the operating lever 52*b* of the boom operating valve 52*a* is operated (a lifting operation or a lowering operation), the boom operating device 52 outputs one of two pilot pressures XAa and XBa (boom drive commands) in accordance with an operating direction of the operating lever 52*b*. The output pilot pressure XAa or XBa is input to the first boom control valve 21. The spool 21*a* of the first boom control valve 21 moves to a position corresponding to the input pilot pressure XAa or XBa and allows the flow of the operating oil to the boom actuator 3 in a direction corresponding to the input pilot pressure XAa or XBa. With this, the boom is lowered by the output of the pilot pressure XAa and lifted by the output of the pilot pressure XBa. The pilot pressure XBa is input to the second boom control valve 33. The second boom control valve 33 allows the flow of the operating oil to the boom actuator 3 at a flow rate corresponding to the pilot pressure XBa. Thus, at the time of the lifting operation, the operating oil is supplied to the boom actuator 3 through the control valves 21 and 33, and at the time of the lowering operation, the operating oil is supplied to the boom actuator 3 through the control valve 21.

When the operating lever 53*b* of the arm operating valve 53*a* is operated (an extending operation or a bending operation), the arm operating device 53 outputs one of two pilot pressures XAb and XBb (arm, drive commands) in accordance with the operating direction of the operating lever 53*b*. The output pilot pressure XAb or XBb is input to the first arm control valve 22 and the second arm control valve 34. The spools 22*a* and 34*a* of the first and second arm control valves 22 and 34 move to positions corresponding to the input pilot pressure XAb or XBb and allow the flow of the operating oil to the arm actuator 4 in a direction corresponding to the input pilot pressure XAb or XBb. To be specific, the operating oil ejected from the first hydraulic pump 11 and the operating oil ejected from the second hydraulic pump 12 are supplied to the arm actuator 4 through the control valves 22 and 34. With this, the arm is extended by the output of the pilot pressure XAb and is bent by the output of the pilot pressure XBb from the boom operating device 52.

When the operating lever 55*b* of the turning operating valve 55*a* is operated (a clockwise operation or a counterclockwise operation), the turning operating device 55 outputs one of two pilot pressures XAs and XBs (turn commands) in accordance with the operating direction of the operating lever 55*b*. The output pilot pressure XAs or XBs is input to the turning control valve 41. The spool 41*a* of the turning control valve 41 moves to a position corresponding to the input pilot pressure XAs or XBs and allows the flow of the operating oil to the turning motor 2 in a direction corresponding to the input pilot pressure XAs or XBs. With this, the turning body is turned clockwise by the output of the pilot pressure XAs and turned counterclockwise by the output of the pilot pressure XBs. Further, the turning operating device 55 includes a selective valve 56. When the turning operating device 55 outputs the pilot pressure XAs or XBs, the selective valve 56 outputs a pilot pressure XCs.

When the operating lever 54*b* (operating lever) of the bucket operating valve 54*a* is operated (a dumping operation or an excavating operation), the bucket operating device 54 outputs one of two pilot pressures XAk0 and XBk0 (bucket drive commands) in accordance with the operating direction of the operating lever 54*b*. The bucket operating device 54 further includes a direction switching valve 57. The pilot pressure XAk0 or XBk0 output from the bucket operating valve 54*a* is input to the direction switching valve 57. The direction switching valve 57 is a switching valve configured to switch a destination to which the pilot pressure XAk0 or XBk0 is output, in accordance with whether or not the operating lever 55*a* of the turning operating device 55 is operated. The direction switching valve 57 includes a spool 57*a*. The spool 57*a* moves between a first position S1 and a second position S2 in accordance with whether or not the pilot pressure XCs is input. When the pilot pressure XCs is output from the selective valve 56, the spool 57*a* moves to the first position S1. When the pilot pressure XCs is not output, the spool 57*a* returns to the second position S2. At the first position S, the input pilot pressure XAk0 or XBk0 is output as a pilot pressure XAk1 or XBk1 (first bucket drive command). At the second position S2, the input pilot pressure XAk0 or XBk0 is output as a pilot pressure XAk2 or XBk2 (second bucket drive command).

The pilot pressure XAk1 or XBk1 is input to the first bucket control valve 32, and the spool 32*a* moves to a position corresponding to the input pilot pressure XAk1 or XBk1. With this, the operating oil ejected from the second hydraulic pump 12 flows to the bucket actuator 5 in a direction corresponding to the input pilot pressure XAk1 or XBk1. To be specific, the bucket performs dumping by the output of the pilot pressure XAk1 and performs excavating by the output of the pilot pressure XBk1. At this time, the first bucket control valve 32 connects the second hydraulic pump 12 and the bucket actuator 5 by an opening area corresponding to the input pilot pressure XAk1 or XBk1, so that the bucket actuator 5 can be extended or contracted at an extension/contraction speed corresponding to the operation amount of the operating lever 54*b* of the bucket operating valve 54*a*.

On the other hand, the pilot pressure XAk2 or XBk2 is input to the second bucket control valve 42, and the spool 42*a* moves to a position corresponding to the input pilot pressure XAk2 or XBk2. With this, the operating oil ejected from the third hydraulic pump 13 flows to the bucket actuator 5 in a direction corresponding to the input pilot pressure XAk2 or XBk2. To be specific, the bucket performs dumping by the output of the pilot pressure XAk2 and performs excavating by the output of the pilot pressure XBk2. At this time, the second bucket control valve 42 connects the third hydraulic pump 13 and the bucket actuator 5 by an opening area corresponding to the input pilot pressure XAk2 or XBk2, so that the bucket actuator 5 can be extended or contracted at a speed corresponding to the operation amount of the operating lever 54*b* of the bucket operating valve 54*a*.

In the hydraulic driving system 1 configured as above, the first boom control valve 21, the first arm control valve 22, the second boom control valve 33, and the second arm control valve 34 are connected to the first hydraulic pump 11 and the second hydraulic pump 12. The turning control valve 41 and the second bucket control valve 42 other than the first boom control valve 21, the first arm control valve 22, the first bucket control valve 32, the second boom control valve 33, and the second arm control valve 34 are connected to the third hydraulic pump 13. Therefore, when the operating lever 52*a* of the boom operating device 52 and the operating lever 53*a* of the arm operating device 53 are operated, the operating oil is supplied from the first hydraulic pump 11 and the second hydraulic pump 12 to the boom actuator 3 and the arm actuator 4. On this account, even when the operating levers 52*a* and 53*a* and the operating lever 55*b* of the turning operating device 55 are operated at the same time, the operating oil ejected from the third hydraulic pump 13 is not supplied to the boom actuator 3 or the arm actuator 4. Further, regardless of the presence or absence of the pilot pressure XAs or XBs, a pressure liquid can be supplied from the first hydraulic pump 11 and the second hydraulic pump 12 to the boom actuator 3 or the arm actuator 4 at a required flow rate.

Since the operating oil ejected from the third hydraulic pump 13 is not supplied to the boom actuator 3 or the arm actuator 4 as above, the third hydraulic pump 13 can be used as a hydraulic pump only for driving the turning motor 2. Therefore, for the purpose of supplying the operating oil from the hydraulic pump preferentially to the turning motor 2, it is unnecessary to restrict the flow rate of the operating oil flowing to the other control valve. On this account, energy loss can be reduced, and energy saving at the time of the turning operation can be achieved. Further, since the third hydraulic pump 13 is a hydraulic pump only for the turning motor 2, the third hydraulic pump 13 is only required to eject the operation oil at a required flow rate corresponding to the operation of the operating lever 55*b* of the turning operating device 55. Thus, the energy saving at the time of the turning operation can be further achieved.

In the hydraulic driving system 1, the second bucket control valve 42 is connected to the third hydraulic pump 13, and in addition, the first bucket control valve 32 that drives the bucket actuator 5 is connected to the second hydraulic pump 12. When the operating lever 54*b* of the bucket operating device 54 is operated while the operating lever 55*b* of the turning operating device 55 is not operated, the direction switching valve 57 outputs the pilot pressure XAk1 or XBk1 to the second bucket control valve 42 to drive the bucket actuator 5 by the third hydraulic pump 13. On the other hand, when the operating lever 55*b* of the turning operating device 55 is operated at the same time as the operating lever 54*b* of the bucket operating device 54, the direction switching valve 57 of the bucket operating device 54 outputs the pilot pressure XAk2 or XBk2 to the first bucket control valve 32 to drive the bucket actuator 5 by the second hydraulic pump 12. To be specific, the bucket actuator 5 is driven in accordance with the presence or absence of the pilot pressure XCs, and the operating oil ejected from the third hydraulic pump 13 is not supplied to the bucket actuator 5 at the time of the turning operation. Therefore, even when the turning operating device 55 and the bucket operating device 54 are operated at the same time, the third hydraulic pump 13 can be used as a hydraulic pump only for driving the turning motor 2. Further, by selectively using one of the first bucket control valve 32 and the second bucket control valve 42 in accordance with the presence or absence of the pilot pressure XCs, the pressure liquid can be supplied to the bucket actuator 5 at a required flow rate regardless of whether or not the turning operation is performed (i.e., regardless of whether or not the operating oil is supplied to the turning motor 2).

As above, in the hydraulic driving system 1, the pressure liquid can be supplied to the boom actuator 3, the arm actuator 4, or the bucket actuator 5 at a required flow rate regardless of whether or not the turning operation is performed. Therefore, even when the boom, the arm, or the bucket is operated at the same time as the turning operation, the pressure liquid can be supplied to each actuator at a required flow rate.

Further, when the operating lever 52*b* of the boom operating device 52, the operating lever 53*b* of the arm operating device 53, or the operating lever 54*b* of the bucket operating device 54 is operated at the same time as the operating lever 55*b* of the turning operating device 55, the operating oil can be supplied to the actuators 3 to 5 from the hydraulic pumps 11 and 12 other than the third hydraulic pump 13. To be specific, the hydraulic pumps 11 to 13 are only required to eject the operating oil at a flow rate required for driving each of the actuators 2 to 5. Therefore, the operating oil can be prevented from being ejected wastefully from the hydraulic pumps 11 to 13.

In the hydraulic driving system 1, the first bucket control valve 32 and the second bucket control valve 42 are substantially the same in configuration as each other, and the opening area of the control valve 32 with respect to the input pilot pressure and the opening area of the control valve 42 with respect to the input pilot pressure are substantially the same as each other. Therefore, the flow rate of the operating oil flowing to the bucket actuator 3 from the first bucket control valve 32 with respect to the operation amount of the operating lever 54*b* of the bucket operating device 54 and the flow rate of the operating oil flowing to the bucket actuator 3 from the second bucket control valve 42 with respect to the operation amount of the operating lever 54*b* of the bucket operating device 54 are substantially the same as each other. If the pilot pressures XAk1 and XAk2 are substantially the same as each other, or the pilot pressures XBk1 and XBk2 are substantially the same as each other, the extension/contraction speeds of the bucket actuator 5 with respect to these pilot pressures can be made substantially the same as each other. Therefore, regardless of whether or not the turning operation is performed, the bucket actuator 5 can be driven at the extension/contraction speed corresponding to the operation amount of the operating lever 54*b* of the bucket operating device 54. Thus, regardless of whether or not the turning operation is performed at the same time, the bucket can be operated by the same operational feeling.

In the hydraulic driving system 1, the first bucket control valve 32 is connected to the second hydraulic pump 12 to which the second boom control valve 33 is connected. Only when the pilot pressure XBa is output from the boom operating device 52, that is, only when the lifting operation of the boom is performed, the second boom control valve 33 supplies the operating oil to the boom actuator 3. To be specific, when the lowering operation of the boom is performed, the second boom control valve 33 does not supply the operating oil to the boom actuator 3. Therefore, when the bucket is operated at the same time as the lowering operation of the boom, the operating oil can be supplied from the second hydraulic pump 12 through the first bucket control valve 32 to the bucket actuator 5 at a required flow rate.

Embodiment 2

A hydraulic driving system 1A of Embodiment 2 is similar in configuration to the hydraulic driving system 1 of Embodiment 1. Therefore, regarding the hydraulic driving system 1A, only components different from the components of the hydraulic driving system 1 of Embodiment 1 will be explained, and explanations of the same components are omitted. The same is true for a hydraulic driving system 1B of Embodiment 3 described below.

In the hydraulic driving system 1A of Embodiment 2, a first bucket control valve 32A includes a movement regulating mechanism 39. When the excavating operation of the bucket is performed while the boom or the arm is operated, the movement regulating mechanism 39 regulates the amount of movement of the spool 32*a* of the first bucket control valve 32A to regulate the flow rate of the operating oil flowing to the bucket actuator 5. The configuration of the movement regulating mechanism 39 will be explained in detail. The movement regulating mechanism 39 is constituted by, for example, a piston 39*a*. The piston 39*a* receives as a pilot pressure PCK a highest pressure among the pilot pressures output from the boom operating valve 52*a* and the arm operating valve 53*a*. The piston 39*a* moves toward the spool 32*a* by the pilot pressure PCK. With this, the movement of the spool 32*a* is regulated, and therefore, the flow rate of the operating oil supplied to the bucket actuator 5 at the time of the excavating operation of the bucket (i.e., at the time of the extending operation of the bucket actuator 5) is regulated. With this, when the turning body is turned, and the boom or the arm is operated at the same time as the bucket, the operating oil can be supplied to the boom actuator 3 or the arm actuator 4 at a required flow rate.

The hydraulic driving system 1A has the same operational advantages as the hydraulic driving system 1 of Embodiment 1.

Embodiment 3

In an hydraulic driving system 1B of Embodiment 3, a first bucket electromagnetic valve 61 and a second bucket electromagnetic valve 62 are provided at the first bucket control valve 32, and a third bucket electromagnetic valve 63 and a fourth bucket electromagnetic valve 64 are provided at the second bucket control valve 42. These four bucket electromagnetic valves 61 to 64 constitute a command output device 60 together with a controller 50B and are connected to the pilot pump 30. Each of the bucket electromagnetic valves 61 to 64 outputs the pilot pressure corresponding to a signal input from the controller 50B. The first bucket electromagnetic valve 61 outputs the pilot pressure XAk1 to the first bucket control valve 32, and the second bucket electromagnetic valve 62 outputs the pilot pressure XBk1 to the first bucket control valve 32. The third bucket electromagnetic valve 63 outputs the pilot pressure XAk2 to the second bucket control valve 42, and the fourth bucket electromagnetic valve 64 outputs the pilot pressure XBk2 to the second bucket control valve 42.

A first sensor PS1 and a second sensor PS2 are provided at the bucket operating device 54, and a third sensor PS3 is provided at the turning operating device 55. The first sensor PS1 detects the pilot pressure XAk0 output from the bucket operating valve 54*a*, and the second sensor PS2 detects the pilot pressure XBk0 output from the bucket operating valve 54*a*. The third sensor PS3 detects the pilot pressure XCs output from the selective valve 56. The first to third sensors PS1 to PS3 are electrically connected to the controller 50B.

The controller 50B outputs first to fourth bucket drive signals in accordance with detection results from the first to third sensors PS1 to PS3. Specifically, when the third sensor PS3 detects the pilot pressure XCs, and the first sensor PS detects the pilot pressure XAk0, the controller 50B outputs the first bucket drive signal corresponding to the pilot pressure XAk0 to the first bucket electromagnetic valve 61. When the third sensor PS3 detects the pilot pressure XCs, and the second sensor PS2 detects the pilot pressure XBk0, the controller 50B outputs the second bucket drive signal corresponding to the pilot pressure XBk0 to the second bucket electromagnetic valve 62. When the third sensor PS3 does not detect the pilot pressure XCs, and the first sensor PS1 detects the pilot pressure XAk0, the controller 50B outputs the third bucket drive signal corresponding to the pilot pressure XAk0 to the third bucket electromagnetic valve 63. When the third sensor PS3 does not detect the pilot pressure XCs, and the second sensor PS2 detects the pilot pressure XBk0, the controller 50B outputs the fourth bucket drive signal corresponding to the pilot pressure XBk0 to the fourth bucket electromagnetic valve 64.

According to the hydraulic driving system 1B configured as above, as with the hydraulic driving system 1 of Embodiment 1, when the operating lever 55*b* of the turning operating device 55 is operated, the third hydraulic pump 13 can be used as a hydraulic pump only for driving the turning motor 2 regardless of whether or not the other operating devices 52 to 54 are operated.

In the hydraulic driving system 1B, a boom electromagnetic valve 71 is provided at the second boom control valve 33, and a first arm electromagnetic valve 72 and a second arm electromagnetic valve 73 are provided at the first arm control valve 22. The boom electromagnetic valve 71 and the two arm electromagnetic valves 72 and 73 are connected to the pilot pump 30, and the operations thereof are controlled by the controller 50B. To be specific, the boom electromagnetic valve 71 outputs the pilot pressure XBa2 corresponding to the signal input from the controller 50B, and the two arm electromagnetic valves 72 and 73 output the pilot pressures XAb2 and XBb2 corresponding to the signals input from the controller 50B.

A fourth sensor PS4 and a fifth sensor PS5 are provided at the boom operating device 52, and a sixth sensor PS6 and a seventh sensor PS7 are provided at the arm operating device 53. The fourth sensor PS4 detects the pilot pressure XAa output from the boom operating valve 52*a*, and the fifth sensor PS5 detects the pilot pressure XBa output from the boom operating valve 52*a*. The sixth sensor PS3 detects the pilot pressure XAb output from the arm operating valve 53*a*, and the seventh sensor PS7 detects the pilot pressure XBb output from the arm operating valve 53*a*. The fourth to seventh sensors PS4 to PS7 are electrically connected to the controller 50B.

The controller 50B outputs a boom drive signal and first and second arm drive signals in accordance with detection results from the fourth to seventh sensors PS4 to PS7. Specifically, when the fifth sensor PS5 detects the pilot pressure XBa, the controller 50B outputs the boom drive signal corresponding to the pilot pressure XBa to the boom electromagnetic valve 71. When the sixth sensor PS6 detects the pilot pressure XAb, the controller 50B outputs the first arm drive signal corresponding to the pilot pressure XAb to the first arm electromagnetic valve 72. When the seventh sensor PS7 detects the pilot pressure XBb, the controller 50B outputs the second arm drive signal corresponding to the pilot pressure XBb to the second arm electromagnetic valve 73.

In the hydraulic driving system 1B configured as above, when the operating lever 52*b* of the boom operating device 52 is operated, the boom operating device 52 outputs the pilot pressure XBa, and the pilot pressure XBa is input to the first boom control valve 21. When the fifth sensor PS5 detects the pilot pressure XBa, the controller 50B outputs the boom drive signal corresponding to the output pilot pressure XBa to the boom electromagnetic valve 71. The boom electromagnetic valve 71 inputs the pilot pressure XBa2 corresponding to the first boom drive signal to the second boom control valve 33. With this, when the operating lever 52*b* of the boom operating device 52 is operated as above, the operating oil can be supplied from the two hydraulic pumps 11 and 12 through the first boom control valve 21 and the second boom control valve 33 to the boom actuator 3, and the boom can be lifted by the two hydraulic pumps 11 and 12.

Similarly, when the operating lever 53*b* of the arm operating device 53 is operated, the arm operating device 53 outputs, for example, the pilot pressure XAb, and the pilot pressure XAb is input to the second arm control valve 34. When the sixth sensor PS6 detects the pilot pressure XAb, the controller 50B13 outputs the first arm drive signal corresponding to the pilot pressure XAb to the first arm electromagnetic valve 72. The first arm electromagnetic valve 72 inputs the pilot pressure XAb2 corresponding to the first arm drive signal to the first arm control valve 22. With this, when the operating lever 53*b* of the arm operating device 53 is operated as above, the operating oil can be supplied from the two hydraulic pumps 11 and 12 through the first arm control valve 22 and the second arm control valve 34 to the arm actuator 4, and the arm can be bent or extended by the two hydraulic pumps 11 and 12.

In the hydraulic driving system 1B configured as above, to perform, for example, a bucket horizontally pulling operation (the lifting operation of the boom and the bending operation of the arm), the operating lever 52*b* of the boom operating device 52 and the operating lever 53*b* of the arm operating device 53 may be operated at the same time. In this case, when the controller 50B detects the pilot pressures XBa and XAb based on the detection results from the fifth sensor PS5 and the sixth sensor PS6, the controller 50B drives the boom actuator 3 only by the first hydraulic pump 11 and drives the arm actuator 4 only by the second hydraulic pump 12 without outputting the boom drive signal and the first arm signal. As above, in the hydraulic driving system 1B, by controlling the operations of the boom electromagnetic valve 71 and the first arm electromagnetic valve 72, the boom actuator 3 and the arm actuator 4 can be driven by the hydraulic pumps 11 and 12, respectively. With this, the operating oil supplied to the boom actuator 3 and the operating oil supplied to the arm actuator 4 can be controlled individually, and therefore, the flow rate of the operating oil can be distributed to the actuators 4 and 5 without waste. Thus, the energy saving of the hydraulic driving system 1B can be achieved.

Further, in the hydraulic driving system 1B, the operating lever 54*b* of the bucket operating valve 54*a* may be operated at the same time as the operating lever 52*b* of the boom operating device 52 and the operating lever 53*b* of the arm operating device 53. In this case, the controller 50B controls the operation of the third or fourth bucket electromagnetic valve 63 or 64 in accordance with the operating direction of the operating lever 54*b* and inputs the pilot pressure XAk2 or XBk2 to the second bucket control valve 42. With this, the operating oil is supplied from the third hydraulic pump 13 through the second bucket control valve 42 to the bucket actuator 5. Therefore, the operating oil supplied to the bucket actuator 5 can be controlled separately from the operating oil supplied to the boom actuator 3 and the operating oil supplied to the arm actuator 4, and therefore, the flow rate of the operating oil can be distributed to the actuators 3 to 5 without waste. Thus, the energy saving of the hydraulic driving system 1B can be achieved.

Furthermore, when the operating lever 52*b* of the boom operating device 52 or the operating lever 53*b* of the arm operating device 53 is operated at the same time as the operating lever 55*b* of the turning operating device 55 and the operating lever 54*b* of the bucket operating device 54, such as when the turning operation of the turning body, the excavating operation of the bucket, and the lifting operation of the boom are performed at the same time, the controller 50B detects three simultaneous operations based on the detection results from the second sensor PS2, the third sensor PS3, and the fifth sensor PS5. When the controller 50B detects the three simultaneous operations, it outputs the boom drive signal to the boom electromagnetic valve 71 and also outputs the second bucket drive signal to the second bucket electromagnetic valve 62. At this time, the controller 50B limits the second bucket drive signal (for example, outputs a signal obtained by multiplying the second bucket drive signal (current) at the time of a single operation by a correction coefficient of less than one) to limit the pilot pressure XBk1 output from the second bucket electromagnetic valve 62. Thus, the amount of movement of the spool 32*a* of the first bucket control valve 32A is regulated, and as a result, the flow rate of the operating oil flowing to the bucket actuator 5 is regulated. With this, when the turning body is turned, and the boom and the bucket are operated at the same time, the operating oil can be supplied to the boom actuator 3 at a required flow rate, Other Embodiments In each of the hydraulic driving systems 1, 1A, and 1B of Embodiments 1 to 3, the first bucket control valve 32 is connected to the second hydraulic pump 12. However, the first bucket control valve 32 may be connected to the first hydraulic pump 11. Further, each of the order of the control valves 21 and 22 disposed on the first center bleed line 23 and the order of the control valves 32, 33, and 34 disposed on the second center bleed line 35 is not limited to the above order and may be any order. Furthermore, the first arm control valve 22 and the second boom control valve 33 are not necessarily required, and one or both of those may not be included.

As in each of the hydraulic driving systems 1, 1A, and 1B of Embodiments 1 to 3, it is preferable that only the turning control valve 41 and the second bucket control valve 42 be connected to the third hydraulic pump 13. However, valves other than control valves, such as the first boom control valve 21, the first arm control valve 22, the second boom control valve 33, and the second arm control valve 34, through which the operating oil is supplied to the actuators 3 and 4 at a high flow rate may be connected to the third hydraulic pump 13. For example, a control valve, such as an auxiliary control valve or a control valve for driving a dozer, through which the operating oil is supplied to the actuator at a relatively low flow rate may be connected to the third hydraulic pump 13.

Each of the hydraulic driving systems 1, 1B, and 1A of Embodiments 1 to 3 may be configured to perform hydraulic drive of a traveling device. In this case, since the flow rate of the operating oil supplied to the traveling motor is high, a control valve through which the operating oil is supplied to a traveling motor of the traveling device is connected to the hydraulic pumps other than the third hydraulic pump 13, that is, to the first hydraulic pump 11 and the second hydraulic pump 12 as with the first boom control valve 21, the first arm control valve 22, the second boom control valve 33, and the second arm control valve 34.

In each of the hydraulic driving systems 1, 1A, and 1B, a plurality of control valves are connected to the first to third hydraulic pumps 11 to 13 in parallel. However, the control valves may be directly connected, and a method of connecting the control valves is not limited.

In each of the hydraulic driving systems 1, 1A, and 1B, the operating oil is used as the pressure liquid. However, the pressure liquid is not limited to the operating oil and may be water, other liquid, or the like. Further, each of the hydraulic driving systems 1, 1A, and 11B is applied to the hydraulic excavator. However, a construction machine to which each of the hydraulic driving systems 1, 1A, and 1B is applied is not limited to the hydraulic excavator and may be a crane, a dozer, or the like, From the foregoing explanation, many modifications and other embodiments of the present invention are obvious to one skilled in the art. Therefore, the foregoing explanation should be interpreted only as an example and is provided for the purpose of teaching the best mode for carrying out the present invention to one skilled in the art. The structures and/or functional details may be substantially modified within the scope of the present invention.

REFERENCE SIGNS LIST

1, 1A, 1B hydraulic driving system
2 turning motor
3 boom actuator
4 arm actuator
5 bucket actuator
11 first hydraulic pump
12 second hydraulic pump
13 third hydraulic pump
21 first boom control valve
22 first arm control valve
32, 32A first bucket control valve
33 second boom control valve
34 second arm control valve
39 movement regulating mechanism
41 turning control valve
42 second bucket control valve
50 controller
50B controller
52 boom operating device
52*b* operating lever
53 arm operating device
53*b* operating lever
54 bucket operating device
54*b* operating lever
55 turning operating device
55*b* operating lever
60 command switching device
61 first bucket electromagnetic valve
62 second bucket electromagnetic valve
63 third bucket electromagnetic valve
64 fourth bucket electromagnetic valve
71 boom electromagnetic valve
72 first arm electromagnetic valve
73 second arm electromagnetic valve

The invention claimed is:

1. A liquid-pressure driving system comprising:

first and second liquid-pressure pump each configured to supply a pressure liquid to a boom actuator through at least one boom control valve, to an arm actuator through at least one arm control valve, and to a bucket actuator through a first bucket control valve;

a third liquid-pressure pump configured to supply the pressure liquid to the bucket actuator through a second bucket control valve and to a turning motor through a turning control valve; and a command output device configured to when supplying the pressure liquid to the bucket actuator while the pressure liquid is supplied from the third liquid-pressure pump to the turning motor, output a first bucket drive command to the first bucket control valve such that the pressure liquid is supplied from the first or second liquid-pressure pump through the first bucket control valve to the bucket actuator and when supplying the pressure liquid to the bucket actuator while the pressure liquid is not supplied to the turning motor, output a second bucket drive command such that the pressure liquid is supplied from the third liquid-pressure pump through the second bucket control valve to the bucket actuator.

2. The liquid-pressure driving system according to claim 1, further comprising a bucket operating device including an operating lever and configured to output a bucket drive command in accordance with an operation amount of the operating lever, wherein:

the first to third liquid-pressure pumps are configured such that ejection amounts thereof are substantially the same as one another;

the command output device outputs the first bucket drive command or the second bucket drive command in accordance with the bucket drive command;

the first bucket control valve connects the first and second pressure liquid pumps and the bucket actuator by an opening area corresponding to the first bucket drive command from the command output device;

the second bucket control valve connects the third pressure liquid pump and the bucket actuator by an opening area corresponding to the second bucket drive command from the command output device; and the opening area of the first bucket control valve and the opening area of the second bucket control valve are substantially the same as each other when the first bucket drive command and the second drive command are substantially the same as each other.

3. The liquid-pressure driving system according to claim 1, wherein:

the arm control valve is connected to at least one of the first liquid-pressure pump and the second liquid-pressure pump; and the boom control valve is connected to the other liquid-pressure pump.

4. The liquid-pressure driving system according to claim 1, wherein:

the at least one arm control valve comprises two arm control valves, and the two arm control valves are connected to the first liquid-pressure pump and the second liquid-pressure pump, respectively;

the at least one boom control valve comprises two boom control valves, and the two boom control valves are connected to the first liquid-pressure pump and the second liquid-pressure pump, respectively;

when lowering a boom that is lifted or lowered by the boom actuator, one of the two boom control valves stops supply of the pressure liquid to the boom actuator from the liquid-pressure pump to which the one boom control valve is connected; and the first bucket control valve is connected to the liquid-pressure pump to which the one boom control valve is connected.

5. The liquid-pressure driving system according to claim 1, wherein:

the first to third liquid-pressure pumps are variable displacement pumps;

the first to third liquid-pressure pumps are provided with first to third regulators, respectively, the first to third regulators being configured to control ejection amounts of the first to third liquid-pressure pumps, respectively; and the third regulator controls the ejection amount of the third liquid-pressure pump separately from the ejection amounts of the first and second liquid-pressure pumps.

6. The liquid-pressure driving system according to claim 1, wherein:

the first bucket control valve includes a first bucket spool configured to move to a position corresponding to the first bucket drive command and connect the first and/or second liquid-pressure pump and the bucket actuator by an opening area corresponding to an amount of movement of the first bucket spool and a movement regulating mechanism configured to regulate the amount of movement of the first bucket spool; and when the pressure liquid is supplied to at least one of the boom actuator and the arm actuator while the pressure liquid is supplied to the turning motor, and the command output device outputs the first bucket drive command, the movement regulating mechanism regulates the amount of movement of the first bucket spool.

7. The liquid-pressure driving system according to claim 1, wherein:

the command output device includes an electromagnetic control valve configured to adjust a pilot pressure output as the first bucket drive command to the first bucket control valve and a control unit configured to control an operation of the electromagnetic control valve;

the first bucket control valve connects the third liquid-pressure pump and the bucket actuator by an opening area corresponding to the pilot pressure, and the opening area of the first bucket control valve decreases when the pilot pressure is reduced; and when the pressure liquid is supplied to at least one of the boom actuator and the arm actuator while the pressure liquid is supplied to the turning motor, and the command output device outputs the first bucket drive command, the control unit reduces the pilot pressure by the electromagnetic control valve.

* * * * *